US005415615A

United States Patent [19]

Culpepper

[11] Patent Number: 5,415,615

[45] Date of Patent: May 16, 1995

[54] MACHINE FOR ERECTING SLEEVE TYPE CARTONS FOR LOADING

[75] Inventor: Will L. Culpepper, Covington, Ga.

[73] Assignee: The Mead Corporation, Dayton, Ohio

[21] Appl. No.: 123,681

[22] Filed: Sep. 20, 1993

[51] Int. Cl.[6] ..... B31B 5/78; B31B 3/80

[52] U.S. Cl. ..... 493/315; 53/566

[58] Field of Search ..... 493/123, 124, 125, 315; 53/564, 566

[56] References Cited

U.S. PATENT DOCUMENTS

| | | | |
|---|---|---|---|
| 2,601,481 | 6/1952 | Williams | 493/315 |
| 2,671,385 | 3/1954 | Johenning et al. | 493/315 |
| 2,760,415 | 8/1956 | Hornsteiner | 493/315 |
| 2,984,162 | 5/1961 | Gordon | 493/315 |
| 3,122,071 | 2/1964 | Vogel | 493/315 |
| 3,242,827 | 3/1966 | Winters | 493/315 |
| 3,599,541 | 8/1971 | Allen | 493/315 |
| 3,633,470 | 1/1972 | Bingham | 493/315 |
| 3,783,752 | 1/1974 | Langen et al. | 493/315 |
| 3,991,660 | 11/1976 | Calvert et al. | 93/53 |
| 5,019,029 | 5/1991 | Calvert | 493/315 |
| 5,061,231 | 10/1991 | Dietrich et al. | 493/315 |
| 5,102,385 | 4/1992 | Calvert | 493/315 |
| 5,176,612 | 1/1993 | Calvert et al. | 493/315 |

FOREIGN PATENT DOCUMENTS

| | | | |
|---|---|---|---|
| 0510953 | 4/1992 | European Pat. Off. | B31B 5/80 |

*Primary Examiner*—William E. Terrell
*Attorney, Agent, or Firm*—Kennedy & Kennedy

[57] ABSTRACT

A machine (10) for erecting end loading sleeve type cartons (20) having oppositely disposed panels has a hopper (11), a carton extraction wheel (28), an intermediary wheel (29), a delivery wheel (30) and a conveyor (13). The extraction wheel has reciprocal moving suction cups (32) for gripping and extracting a carton from the hopper. The intermediary wheels has suction cups (33, 34) for gripping and relaying the carton from the carton extraction wheel. The delivery wheels has suction cups (36, 37) for gripping and relaying the carton from the intermediary wheel while simultaneously separating the panels of the cartons.

7 Claims, 5 Drawing Sheets

MACHINE FOR ERECTING SLEEVE TYPE CARTONS FOR LOADING

TECHNICAL FIELD

This invention relates to machines for extracting end loading sleeve type cartons in a collapsed configuration from a hopper, erecting them and positioning them in an open configuration upon a conveyor for loading.

BACKGROUND OF THE INVENTION

Machines are used to erect end loading sleeve type cartons from a flat, collapsed configuration to an open configuration in preparation for loading with products. These machines employ hoppers which contain stacks of cartons in their flat, collapsed configurations. The cartons are sequentially moved to a position within the hopper where the carton erecting machinery may grasp them to initialize the erection process.

Typically, these hoppers have been oriented uprightly so that each carton may gravitate into position for extraction as shown in U.S. Pat. Nos. 5,019,029 and 5,176,612. To reduce the frequency in which the hopper must be loaded, a large stack of cartons is typically loaded at once. As large stacks are oftentimes loaded upon previously loaded cartons, a person loading the hopper must be elevated well above the machinery to accomplish this task with its attendant risk of personal injury. In addition to the risk of injury, the combined weight of the cartons upon the bottommost carton often makes it difficult to be grasped and removed readily.

To alleviate these problems conveyor belts have been employed which load the hopper with cartons at the same rate at which they are extracted. The cartons are typically placed on the conveyor so as to overlap or "shingle" each other. However, rough surfaces of some cartons or the end flaps of overlapping cartons often causes them to interlock which in turn cause them to be improperly or only partially loaded into the hopper.

It thus is seen that a need remains for a machine for erecting sleeve type cartons in a safer, more efficient and reliable manner. Accordingly, it is to the provision of such an improved machine that the present invention is primarily directed.

SUMMARY OF THE INVENTION

In preferred form of the invention, a machine is provided for sequentially extracting collapsed sleeve type end loading cartons having oppositely disposed panels from a hopper and positioning them in an opened configuration upon a conveyor. The machine comprises a series of carton transport wheels each bearing suction means for releasable gripping the carton panels. The series of carton transport wheels includes a carton extraction wheel mounted adjacent an end of the hopper, a delivery wheel mounted adjacent the conveyor, and an intermediary wheel mounted adjacent the delivery wheel. The machine also includes means for rotating the carton extraction wheel and delivery wheel in one rotary direction and the intermediary wheel in the opposite rotary directions.

Suction control means operates the suction means on each of the wheels in timed relation for the sequential extraction of cartons from the hopper, the relay of the cartons through the series of transport wheels, and the delivery of the cartons to the conveyor. The cartons are delivered to the conveyor in an at-least partially opened configuration by the maintenance of suction of the intermediary wheel and delivery wheel suction means in timed coincidence to cause the oppositely disposed panels of cartons being relayed from the intermediary wheel to the delivery wheel to be spread apart.

DETAILED DESCRIPTION

Figure 1:
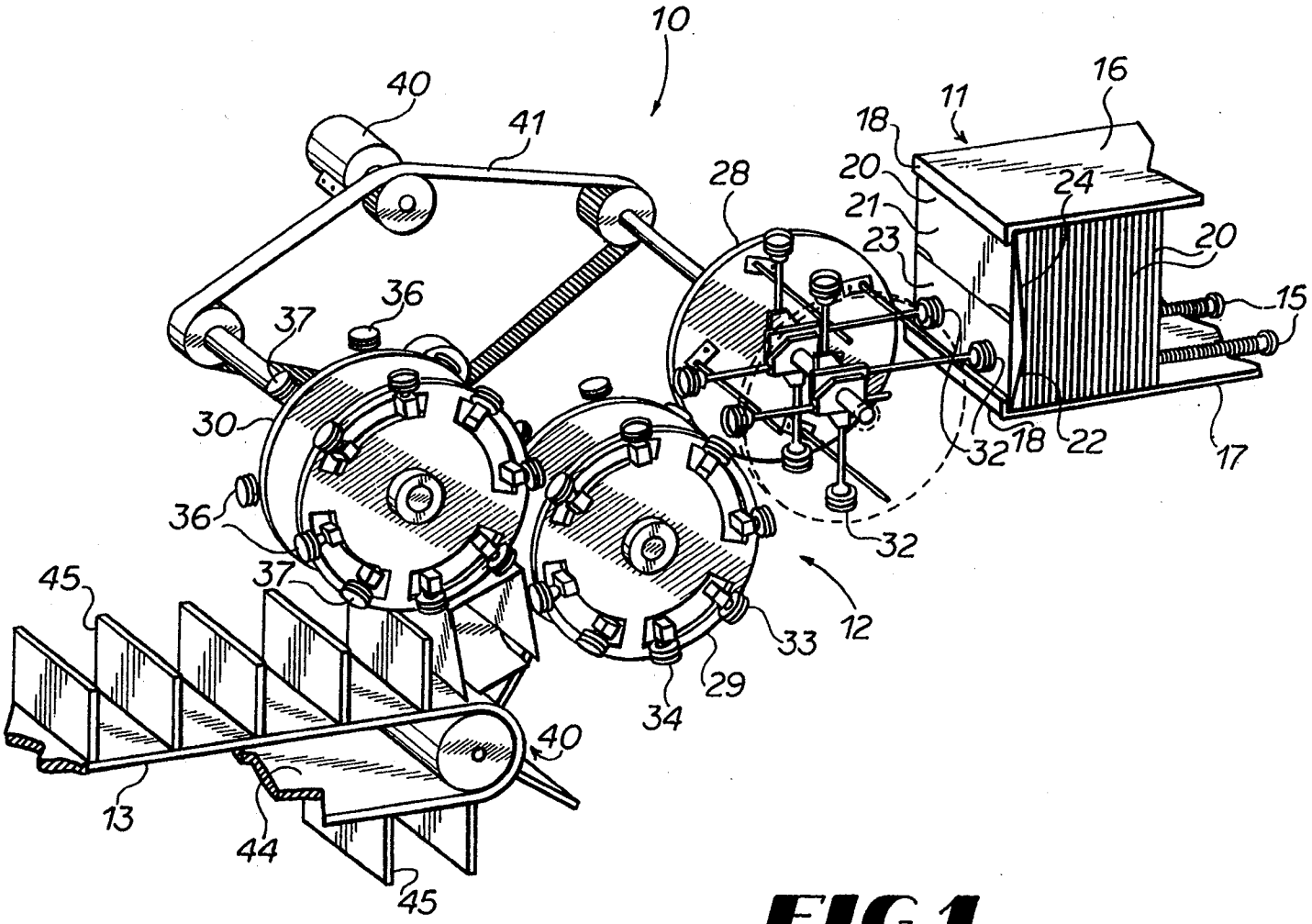
FIG. 1 is a perspective view of an assembly of operative elements a machine embodying principles of the invention in a preferred form.

With reference next to the drawing, there is shown in FIG. 1 a machine 10 having a substantially horizontal hopper 11, a series of carton transport wheels 12 and an endless conveyor 13, support structures of the machine being removed for clarity of explanation. The hopper 11 has a top panel 16, a bottom panel 17, and a pair of threaded drive screws 15 partially extending through the bottom panel 17. The top and bottom panels 16 and 17 each have inturned ends 18. A group of collapsed, sleeve type end loading cartons 20 are shown stacked uprightly within the hopper 11. Each carton 20 has a top panel 21, a bottom panel 22 oppositely disposed from the top panel 21 once the carton is opened, two oppositely disposed side panels 23 and 24, in a carton open configuration, which extend between and joined to the top and bottom panels 21 and 22.

The machine has a series of carton transport wheels 12 that rotate at the same and constant speed. The transport wheels 12 include a carton extraction wheel 28, an intermediary or relay wheel 29 and a delivery wheel 30. Each transport wheel is equipped with gripping mechanisms for releasably gripping the carton panels. Each gripping mechanism includes a set of vacuum cups, described in more detail hereafter, to which a vacuum pressure may be selectively supplied by unshown but conventional vacuum control means. Preferably these gripping mechanisms are those shown in detail in U.S. Pat. No. 5,019,029 which is also owned by the assignee of the present invention.

The carton extraction wheel 28 is equipped with four pairs of vacuum cups 32 mounted for reciprocal movement so as to extend outwardly to engage and withdraw the endmost carton from the stack within the hopper 11. The intermediary wheel 29 has four pairs of leading vacuum cups 33 and four pairs of trailing vacuum cups 34. The delivery wheel 30 has four pairs of leading vacuum cups 36 and four pairs of trailing vacuum cups 37. A motor 40 is coupled to the wheels 28, 29 and 30 by an endless drive belt 41. The conveyor 13 has an end 40 mounted adjacent the delivery wheel 30 and an endless conveyor belt 44 having a series of outwardly extending, mutually spaced flight bars 45.

Since the hopper 11 is substantially horizontal, cartons may be stacked horizontally as opposed to vertically as with the previous carton erecting machines. Preferably the hopper is oriented less than 15° off horizontal. This orientation of the hopper allows a person loading the cartons to do so without being elevated.

Figure 2:
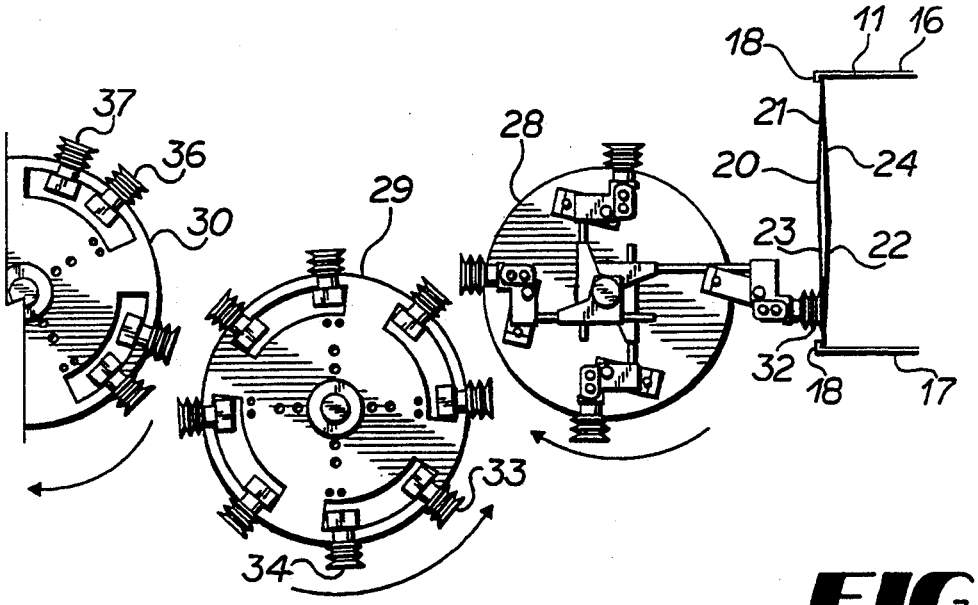
FIGS. 2–9 are a sequence of schematic views of portions of the assembly of FIG. 1 showing a carton being extracted from a hopper, the extracted carton being relayed, opened and delivered onto a conveyor.
Figure 3:
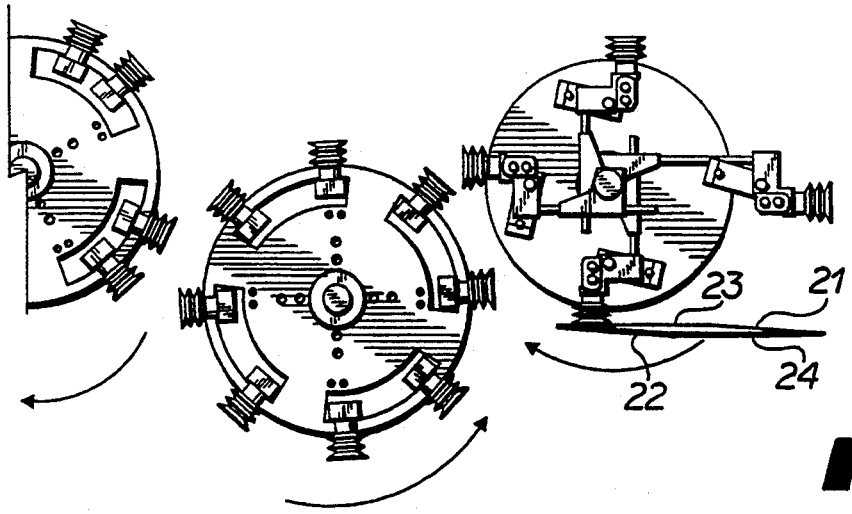
Figure 4:
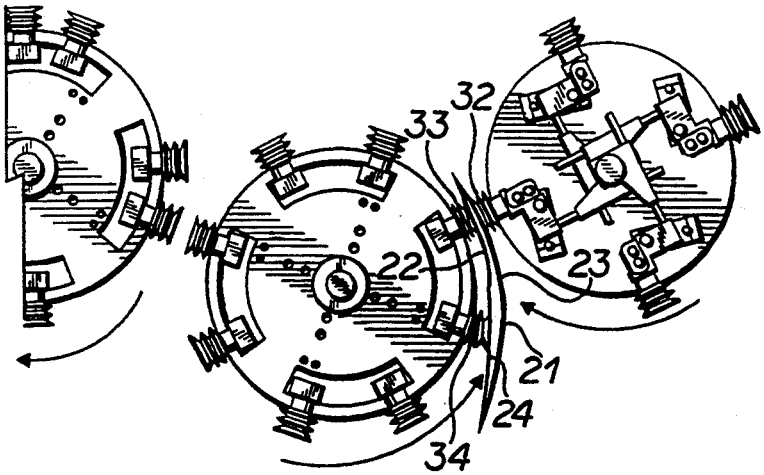
Figure 5:
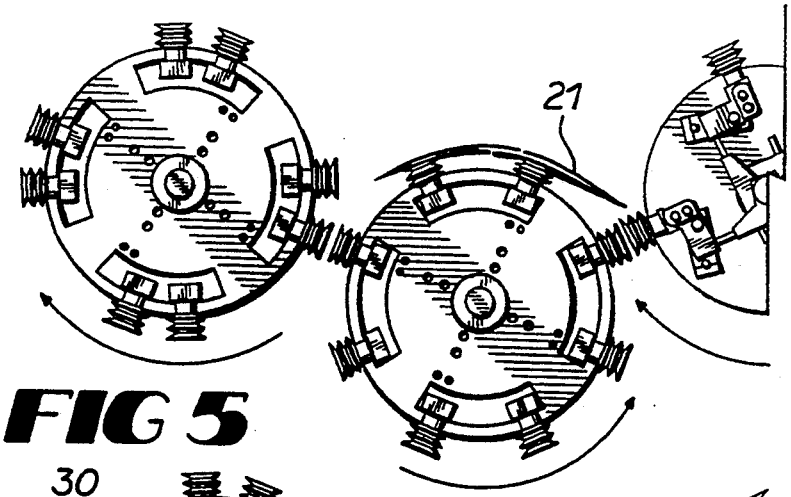

As the extraction wheel 28 is rotatably driven by motor 40 in a clockwise direction, as viewed in FIGS. 1–9, a pair of extraction wheel vacuum cups 32, supplied with vacuum pressure by the vacuum control means, is extended to a position where they engage and grip the side panel 23 of the endmost carton 20 adjacent the cartons lower edge, as shown in FIG. 2. These vacuum cups 32 are then retracted to their initial position thereby causing the lower edge of the carton to be pulled past the inturned edge 18 of the hopper and extracted therefrom as shown in FIG. 3. As shown in FIG. 4, as the extraction wheel 28 continues to rotate its suction cups 32 holding the carton become aligned with the leading suction cups 33 of the counter-rotating, intermediary wheel 29, which is always rotating counterclockwise as viewed in FIGS. 1–9. As shown at time unit 4 in FIG. 10, at this point in time vacuum pressure is applied to both suction cups 32 and 33 to insure that the leading suction cups 33 of intermediary wheel 29 are able to grip the carton bottom panel 22 before the extraction wheel suction cups 32 release the carton. Shortly thereafter, as shown at time unit 4½ in FIG. 10, the vacuum pressure to the extraction wheel suction cups 32 is terminated so that the carton is released from the carton extraction wheel. Vacuum pressure is then applied to the intermediary wheel trailing suction cups 34, as shown at time 5 in FIG. 10, so that they grip abutting carton side panel 24 thereby completing the relay of the carton 20 from the extraction wheel 28 to the intermediary wheel 29. Though the machine may, of course, be operated at various speeds, a unit of time shown in FIG. 10 would, of course, normally be a small fraction of a second.

Figure 6:
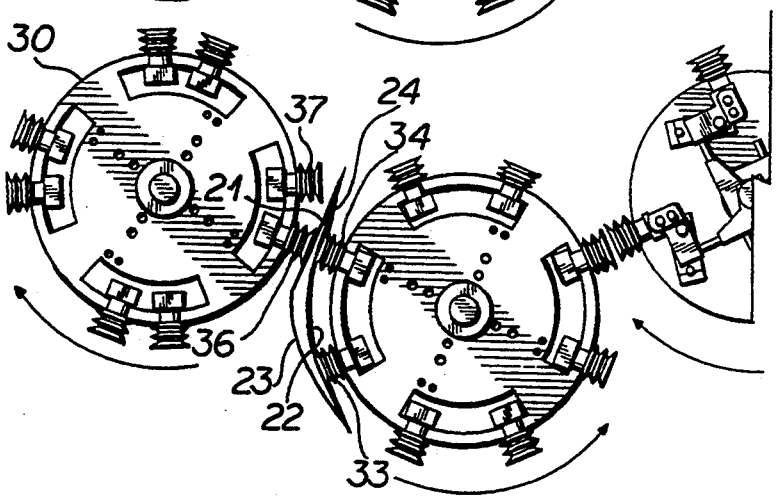
Figure 7:
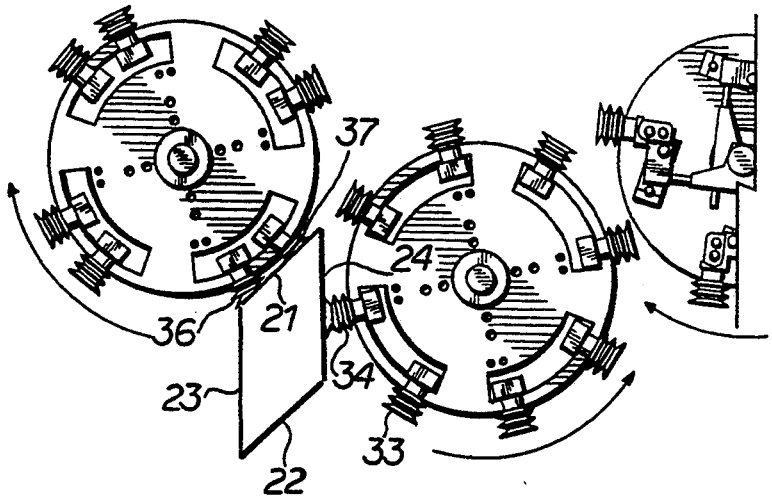

As shown in FIG. 6, continued rotation of the intermediary wheel 29 brings its trailing suction cups 34 into alignment with the leading suction cups 36 of the counter-rotating delivery wheel 30. Vacuum pressure is now applied by the vacuum control means to the delivery wheel leading suction cups 36 immediately prior to this alignment and to the delivery wheel trailing suction cups 37 immediately thereafter, as shown at times 7 and 8 respectively in FIG. 10. With the delivery wheel suction cups 36 and 37 rotating in an opposite direction to the rotary direction of intermediary wheel suction cups 33 and 34, the carton top panel 21 is separated from the oppositely disposed side and bottom panels 24 and 22. As shown in FIG. 7, once the vacuum pressure to the intermediary wheel leading suction cups 33 ceases, as shown at time 8½ in FIG. 10, the carton bottom panel 22 is released and naturally becomes substantially parallel to top panel 21 because of the carton's parallelmatic shape. Continued rotation of wheels 29 and 30 in their opposite directions causes the carton top panel 21 to continue to separate from the side panel 23 so that the carton assumes an open configuration.

Figure 8:
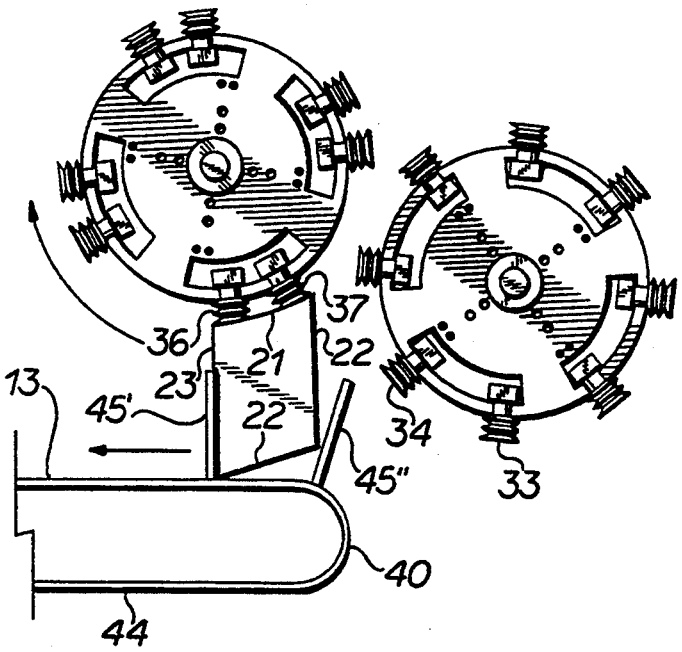
Figure 9:
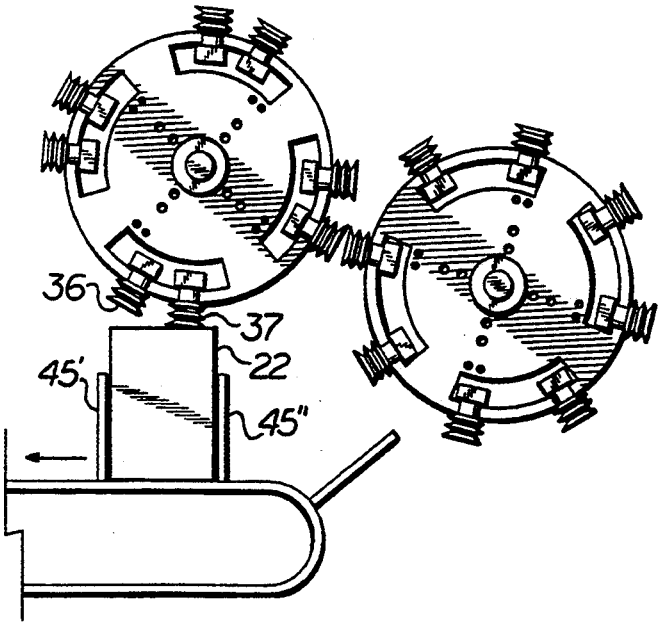
Figure 10:
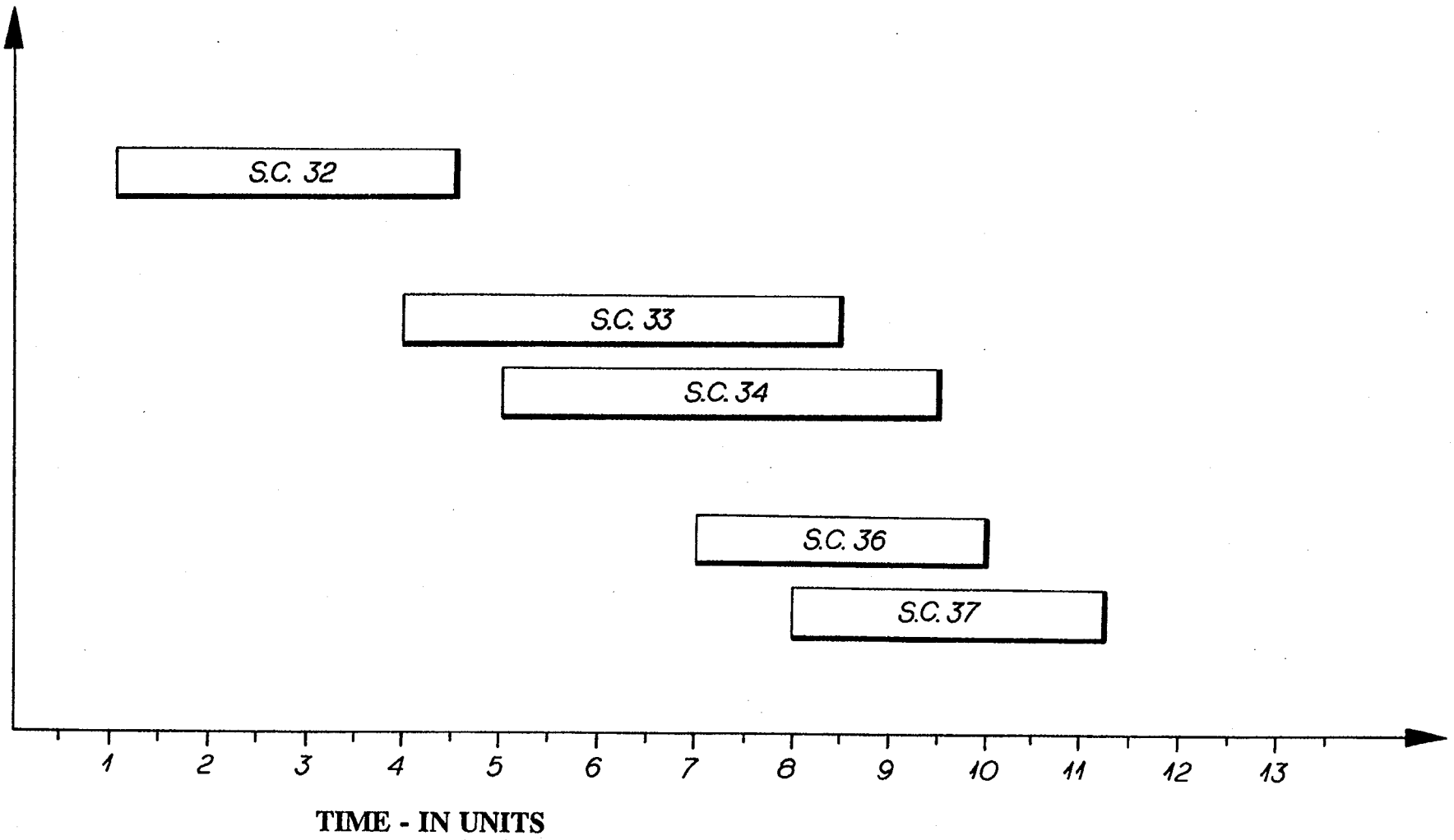
FIG. 10 is a graph showing a preferred operational timing sequence of the suction cups of the machine of FIG. 1.

With reference next to FIG. 8, the substantially opened carton 20 is next brought to a position between a conveyor leading flight bar 45' and a trailing flight bar 45'' after the leading flight bar has completely rounded conveyor end 40 and the trailing flight bar has not yet completely rounded the conveyor end. The carton is positioned with its side panel 23 abutting the continually moving leading flight bar 45'. As the trailing flight bar 45'' completely rounds end 40, and becomes substantially parallel to the leading flight bar 45', it is brought into abutment with carton side panel 22. This positioning of the flight bars 45' and 45'' against the carton side panels 23 and 22 both squares and maintains the carton in a fully open configuration. Shortly thereafter the vacuum control means terminates vacuum pressure to the delivery wheel leading suction cups 36, as shown in FIG. 9 and at time 10 in FIG. 10, and to the delivery wheel trailing suction cups 37. This completes the relay of the carton from the delivery wheel 30 onto the conveyor 13.

If desired the suction cups of the intermediary and delivery wheel may be adjustably mounted along the wheel periphery to different radials so that the angular spacing between the leading and trailing suction cup may be varied to accommodate cartons of different sizes. Also, the vacuum control means may be adjusted so that the extraction wheel, along with the intermediary wheel and delivery wheel, grips one, two or four cartons per rotation.

With this construction of the machine cartons are stacked horizontally and the person loading the cartons does not have to be elevated well above the floor upon which the machine is located. The horizontal stacking of the cartons also eliminates carton interlocking problems associated with cartons having rough surfaces or the end flaps.

From the foregoing it is seen that a machine for erecting end loading sleeve type cartons is now provided which overcomes problems long associated with those of the prior art. It should however be understood that the just described embodiment merely illustrates principles of the invention in its preferred form. Many modifications, additions and deletions may be made without departure from the spirit and scope of the invention as set forth in the following claims.

I claim:

1. A machine for sequentially extracting collapsed sleeve type end loading cartons having oppositely disposed panels from a hopper and positioning them in an opened configuration upon a conveyor, said machine comprising a series of carton transport wheels each bearing suction means for releasably gripping the carton panels, said series of rotating carton transport wheels including a carton extraction wheel mounted adjacent an end of the hopper, a delivery wheel mounted adjacent the conveyor, and an intermediary wheel mounted adjacent said delivery wheel; means for rotating said carton extraction wheel; means for rotating said delivery wheel and said intermediary wheel in opposite rotational directions; and suction control means for operating said suction means in timed relation to sequentially extract the cartons from the hopper with said suction means of said extraction wheel, to relay the cartons from one said transport wheel to another said transport wheel of said series of transport wheels, and to deliver the cartons from the delivery wheel to the conveyor in an at-least partially opened configuration by the maintenance of suction of said intermediary wheel and delivery wheel suction means in timed coincidence to cause the oppositely disposed panels of cartons being relayed from said intermediary wheel to said delivery wheel to be spread apart.

2. The machine of claim 1 wherein said intermediary wheel is mounted adjacent said extraction wheel.

3. A machine for sequentially extracting and opening collapsed sleeve type end loading cartons having oppositely disposed panels, said machine comprising:

a hopper for holding a stack of cartons;

a carton extraction wheel mounted adjacent an end of said hopper;

a carton delivery wheel;

an intermediate carton transport wheel mounted adjacent said delivery wheel;

means for rotating said extraction wheel;

means for rotating said delivery wheel and said intermediate wheel in opposite rotational directions;

an endless conveyor mounted adjacent said delivery wheel;

suction means mounted to each of said wheels for releasably gripping the cartons; and suction control means for operating said suction means in timed relation to sequentially extract the cartons from said hopper by said suction means of said carton extraction wheel, to relay the cartons from one said wheel to another said wheel adjacent said one wheel, and to deliver the cartons to the conveyor in an at-least partially opened configuration by the simultaneous maintenance of suction on said intermediary wheel suction means in gripping engagement with one of the oppositely disposed panels of a carton and on said delivery wheel suction means in gripping engagement with the other panel of the carton to cause the oppositely disposed panels of the cartons being relayed from said intermediary wheel to said delivery wheel to be spread apart.

4. The machine of claim 3 wherein said hopper is oriented substantially horizontal and has drive means for driving the cartons towards said extraction wheel.

5. The machine of claim 4 wherein said drive means includes at least one drive screw.

6. The machine of claim 3 wherein said intermediary wheel is mounted adjacent said extraction wheel.

7. The machine of claim 3 wherein said delivery wheel suction means includes suction cups extending outwardly from said delivery wheel and adjusting means for varying the circumferential spacing between each said suction cups so as to grip cartons of various sizes.

* * * * *